US007464755B2

(12) United States Patent
Edwards

(10) Patent No.: US 7,464,755 B2
(45) Date of Patent: Dec. 16, 2008

(54) METHODS AND SYSTEMS FOR SAMPLING HEAVY OIL RESERVOIRS

(75) Inventor: John Edwards, Medinat Al Alam (OM)

(73) Assignee: Schlumberger Technology Corporation, Sugar Land, TX (US)

( * ) Notice: Subject to any disclaimer, the term of this patent is extended or adjusted under 35 U.S.C. 154(b) by 87 days.

(21) Appl. No.: 11/609,402

(22) Filed: Dec. 12, 2006

(65) Prior Publication Data

US 2008/0135239 A1 Jun. 12, 2008

(51) Int. Cl.
*E21B 49/08* (2006.01)

(52) U.S. Cl. ..... 166/264; 166/62

(58) Field of Classification Search ..... 166/264, 166/369, 57, 62
See application file for complete search history.

(56) References Cited

U.S. PATENT DOCUMENTS

| | | | | |
|---|---|---|---|---|
| 3,611,799 | A | 10/1971 | Davis | |
| 4,416,152 | A | 11/1983 | Wilson | |
| 4,860,581 | A | 8/1989 | Zimmerman | |
| 4,936,139 | A | 6/1990 | Zimmerman | |
| 5,303,775 | A | 4/1994 | Michaels | |
| 5,377,755 | A | 1/1995 | Michaels | |
| 5,934,374 | A | 8/1999 | Hrametz | |
| 6,015,015 | A | 1/2000 | Luft | |
| 6,145,547 | A | 11/2000 | Villatte | |
| 6,223,822 | B1 | 5/2001 | Jones | |
| 6,230,557 | B1 | 5/2001 | Ciglenec | |
| 6,301,959 | B1 | 10/2001 | Hrametz | |
| 6,425,735 | B1 | 7/2002 | Sheth | |
| 6,457,544 | B1 | 10/2002 | Sung | |
| 6,668,924 | B2 | 12/2003 | Bolze | |
| 6,745,815 | B1 | 6/2004 | Senyard | |
| 6,932,160 | B2 * | 8/2005 | Murray et al. | 166/369 |
| 2005/0082059 | A1 | 4/2005 | Nogueira | |
| 2005/0279494 | A1 | 12/2005 | Sachdeva | |
| 2005/0279499 | A1 | 12/2005 | Tarvin | |
| 2006/0175053 | A1 | 8/2006 | Marchal | |
| 2006/0231256 | A1 | 10/2006 | Rivas | |

FOREIGN PATENT DOCUMENTS

| | | | |
|---|---|---|---|
| WO | 9630628 | A1 | 10/1996 |

(Continued)

OTHER PUBLICATIONS

Applicants' U.S. Appl. No. 11/426,359, filed Jun. 26, 2006 entitled "Compositions and Methods of Using Same in Producing Heavy Oil and Butimen".

*Primary Examiner*—William P Neuder
(74) *Attorney, Agent, or Firm*—Jeffrey L. Wendt; Wayne I. Kanak

(57) ABSTRACT

Methods and systems and are described for isolating or manipulating a sample of a heavy oil composition from a hydrocarbon reservoir. One method embodiment of the invention comprises circulating a heated fluid in a first region of a reservoir where a heavy oil composition is present or believed present using a surface pump and a well completion comprising a downhole pump for a time and flow rate sufficient to produce flowable heavy oil composition, the well completion comprising a sampling tool; and sampling the flowable heavy oil composition using the sampling tool. This abstract complies with rules requiring an abstract. It should not be used to limit the scope or meaning of the claims. 37 CFR 1.72(b).

19 Claims, 8 Drawing Sheets

FOREIGN PATENT DOCUMENTS

| | | | |
|---|---|---|---|
| WO | 9701017 | A1 | 1/1997 |
| WO | 9915755 | A2 | 4/1999 |
| WO | 03008761 | A1 | 1/2003 |
| WO | 2004097159 | A2 | 11/2004 |

* cited by examiner

METHODS AND SYSTEMS FOR SAMPLING HEAVY OIL RESERVOIRS

BACKGROUND OF THE INVENTION

1. Field of Invention

The present invention relates generally to the field of fluid sample handling and/or interfacial rheology measurement at temperature and pressure conditions existing at the source of the sample, or at least temperatures different than ambient, including, but not limited to, reservoir hydrocarbon and aqueous based fluids, drilling muds, frac fluids, and the like having multiple phases (solids and liquid).

2. Related Art

The desirability of taking downhole formation fluid samples for chemical and physical analysis has long been recognized by oil companies, and such sampling has been performed by the assignee of the present invention, Schlumberger, for many years. Samples of formation fluid, also known as reservoir fluid, are typically collected as early as possible in the life of a reservoir for analysis at the surface and, more particularly, in specialized laboratories. The information that such analysis provides is vital in the planning and development of hydrocarbon reservoirs, as well as in the assessment of a reservoir's capacity and performance.

The process of wellbore sampling involves the lowering of a sampling tool into the wellbore to collect a sample or multiple samples of formation fluid by engagement between a probe member of the sampling tool and the wall of the wellbore. Many known sampling tools create a pressure differential across such engagement to induce formation fluid flow into one or more sample chambers within the sampling tool. This and similar processes are described in U.S. Pat. Nos. 4,860,581; 4,936,139 (both assigned to Schlumberger); U.S. Pat. Nos. 5,303,775; 5,377,755 (both assigned to Western Atlas); and U.S. Pat. No. 5,934,374 (assigned to Halliburton). Other examples of downhole sampling tools are disclosed in U.S. Pat. Nos. 6,223,822; 6,457,544; 6,668,924, and published U.S. patent applications 20050082059; 20050279499; and 20060175053, all assigned to the assignee of the present invention. These references are incorporated herein by reference for their disclosure of downhole sampling tools. The desirability of housing at least one, and often a plurality, of such sample chambers, with associated valving and flow line connections, within "sample modules" is also known. Each type of sampling tool provides certain advantages for certain conditions. The tools described in the art are typically probe sampling tools for new wells that have just been drilled, are full of over balanced mud and have a sealing mudcake between the higher pressured wellbore and the lower pressured reservoir. This invention is for a producing well with mud removed, no mudcake, and the pressure in the wellbore less than the reservoir pressure. It is annular fluid sampling that is augmented by the heat delivered with the insulated coil, not probe sampling. however, for oils having viscosity above 1000 cp, the existing sampling methods and tools may not be adequate.

As sources of light hydrocarbon oil are depleted with time, heavy oil has for several years now been gaining the attention of oil companies. Heavy oil reservoirs need thermal stimulation to reduce viscosity of the heavy oil so the oil may flow. The viability of developing a new heavy oil reservoir depends on the oil's viscosity change with temperature. This fluid property is different for different heavy crude oils, and is typically measured in a laboratory on a fluid sample. This measurement is necessary to make a financial model of the heavy oil development, as generating the amount of heat required for flow is the major portion of the cost of production. This in turn has generated a need in the art for obtaining heavy oil samples from the reservoir. Obtaining this sample itself requires heat, as without it the oil will not flow, and this means that heavy oil sampling requires in situ heating.

Although it is possible to heat a portion of a reservoir, using for example electric coils, and then take a sample from that region using a sampling device, it is not an easy proposition, since it is not possible to supply enough power with cables. More power, in the form of heat/hour, can be delivered by pumping a very hot fluid. Pumping heated oil from the surface down conventional tubing to supply heat is not a viable option, however, since fluids heated at the surface lose most of their heat due to heat transfer by the time they reach the sampling region, which may be thousands of meters into a wellbore. Therefore, a long but as yet unmet need exists in the art for a method of applying heat to a portion of a heavy oil reservoir in the region of the reservoir where it is desired to take a sample concurrent with the deployment of a sampling tool in that same region, and actually sampling the reservoir with a device or portion thereof that is used to supply heat to the region of the reservoir of interest. It would further be advantageous if this could be accomplished while reservoir fluids are being pumped to surface.

SUMMARY OF THE INVENTION

In accordance with the present invention, methods and systems for sampling a heavy oil composition from a reservoir bearing a heavy oil composition are described employing a well completion, an insulated tubing, a heated fluid, and an annular downhole sampling tool. The methods and systems of the invention are for sampling a producing well with mud removed, no mudcake, and the pressure in the wellbore is less than the reservoir pressure. Rather than probe sampling tools used primary to sample newly drilled wells, the sampling tools useful in the methods and systems of the invention are annular fluid sampling tools, and it is these tools that are augmented by heat delivered with the insulated coil, not probe sampling tools. As used herein the phrase "heavy oil composition" means a composition at least a portion of which is heavy oil. The term "heavy oil" may have different meanings, and the present application is not intended to be limited to any particular definition. One published set of definitions are those provided by The United Nations Information Centre for Heavy Crude and Tar Sands, which defines bitumen as petroleum having a viscosity >10,000 centipoise (cP); petroleum with viscosity less than 10,000 cP and a density between 10° API and 20° API is defined as heavy oil; and extra heavy oil has a density <10° API. Wile the methods and systems of the present application are applicable to bitumen, heavy oil, and extra heavy oil under these definitions, the term "heavy oil" as used herein will be used, unless otherwise indicated, to include compositions comprising one or more of these. In general, methods and systems of the invention may be used to obtain samples having a viscosity of 1000 cp or greater Heavy oil compositions may comprise components, including, but not limited to hydrocarbons (including sour hydrocarbons which may include hydrogen sulfide, mercaptans, and other sulfur-containing compounds), water, organic and/or inorganic solids, and may include micelles, macromolecules, globules, resins, asphaltenes, hydrocarbon and aqueous based fluids, drilling muds, frac fluids, and the like having multiple phases (solids and liquid). Heavy oil compositions sampled using methods and systems of the invention may comprise one or more of each phase. Stated differently, a heavy oil composition may comprise one or more liquid phases, one or more solid phases, and one or more gaseous phases. Alternatively, depending on the sampling tool used, the sample tool may separate gases from the liquid portions.

One aspect of the invention are methods for sampling a heavy oil composition, one method comprising:

(a) circulating a heated fluid in a first region of a reservoir where a heavy oil composition is present or believed present using a surface pump and a well completion comprising a downhole pump for a time and flow rate sufficient to produce a flowable heavy oil composition, the well completion comprising a sampling tool; and (b) sampling the flowable heavy oil composition using the sampling tool.

Certain embodiments of methods of the invention may comprise:

(a) installing a well completion in a wellbore near a first section of a heavy oil reservoir, the well completion comprising:
  (i) a non-insulated tubing;
  (ii) a downhole pump connected to an end of the non-insulated tubing; and
  (iii) a bypass tubing;

(b) inserting an insulated coiled tubing through the bypass tubing, a distal end of the insulated coiled tubing having a sampling tool affixed thereto;

(c) pumping a heated non-volatile oil through the insulated coiled tubing and into the first section of the reservoir using a surface pump;

(d) pumping at least a portion of the heated non-volatile oil to the surface using the downhole pump until heated heavy oil begins to flow from the first section of reservoir;

(e) stopping the surface pump, thus stopping pumping of the heated non-volatile oil, while maintaining pumping using the downhole pump; and (f) sampling heavy oil using the sampling tool.

Methods within the invention include those comprising inserting a plug, such as a sand plug, in the wellbore near the first region, so that one or more other regions of the reservoir above the first region may be sampled. Other methods of the invention include analyzing viscosity of the sampled heavy oil composition; the steps of circulating, sampling, and analyzing may be repeated for one or more other regions of the reservoir. Yet other methods of the invention comprise making a financial model of producing the heavy oil composition from the reservoir using the at least the viscosity analysis results. The sampling of the heavy oil composition may be synchronized with the shutting down of the surface pump, or the sampling times or intervals may be set according to a timer.

Methods of the invention may include measuring temperature vs. time on the sampling tool, and optionally recording the sampling temperature vs. time. This may be a battery-powered memory measurement. Exemplary methods of the invention comprise sampling the same region of the wellbore at different temperatures, with the temperature controlled via the pumped heated fluid. A surface heater may be used to supply varying fluid temperatures to the heated fluid flowing through the insulated coil, and thus to the region being sampled. This allows measuring the reservoir oil recovered as a function of different temperatures, and this temperature variant sampling could be repeated at different depths or regions of the reservoir. Thus methods of the invention may be used to sample the production of heavy oil as a function of temperature as well as depth in the reservoir.

Another aspect of the invention are systems for carrying out a methods of the invention.

Methods and systems of the invention will become more apparent upon review of the detailed description of the invention and the claims that follow.

BRIEF DESCRIPTION OF THE DRAWINGS

The manner in which the objectives of the invention and other desirable characteristics may be obtained is explained in the following description and attached drawing in which.

Figure 1:
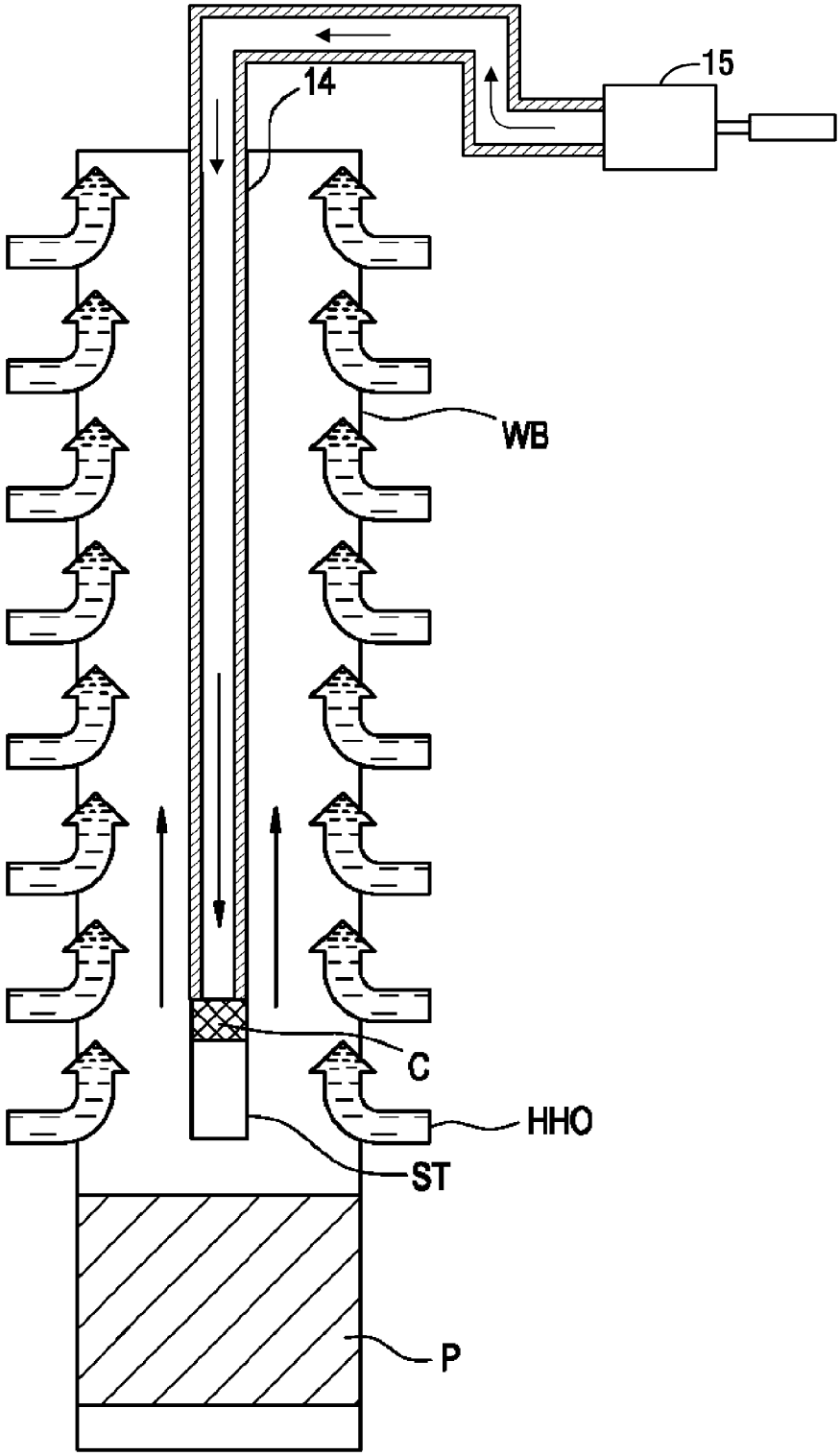
FIG. 1 is a schematic diagram of one system and method of the invention.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible. The term "reservoir" may include hydrocarbon deposits accessible by one or more wellbores. A "wellbore" includes cased, cased and cemented, or open-hole wellbores, and may be any type of well, including, but not limited to, a producing well, a non-producing well, an experimental well, an exploratory well, and the like. Wellbores may be vertical, horizontal, any angle between vertical and horizontal, diverted or non-diverted, and combinations thereof, for example a vertical well with a non-vertical component. The phrase "high temperature, high pressure" means any temperature and pressure conditions that are above atmospheric pressure and above 20° C.

Heavy oil reservoirs are typically low pressured, often sub-hydrostatic. This means the heavy oil, even when heated to reduce the viscosity, will not flow naturally to surface. Therefore heavy oil reservoirs need an artificial lift system. Consequently, methods and systems of the invention applying heat to the reservoir while sampling are compatible with an artificial lift system.

The technology for lifting a well and simultaneously providing access to the reservoir is known using a bypass tubing called a Y-tool, from a leg of which is deployed the downhole pump, either an electrical submersible pump (ESP) or progressive cavity pump (PCP). As used today this bypass tubing allows passage of non-insulated coiled tubing to the reservoir. This non-insulated coiled tubing may be used to pump fluids such as water, stimulating fluids such as acids, and water shutoff fluids such as gels and cement. However, it is not practical to pump heated fluids through non-insulated coiled tubing as the conductive metallic coil conducts most of the heat away from the fluid before it reaches the reservoir. Methods and systems of the invention address this shortcoming.

Systems of the invention comprise a well completion, and methods of the invention include installing a well completion in the wellbore prior to sampling the heavy oil composition in the reservoir. As used herein the terms "well completion" and "completion"are used as nouns except when referring to a completion operation. Well completions within the invention include, but are nor limited to, casing completions, commingled completions, coiled tubing completions, dual completions, high temperature completions, high pressure completions, high temperature/high pressure completions, multiple completions, natural completions, artificial lift completions, partial completions, primary completions, tubingless completions, and the like. Furthermore, one or more primary completion components may be comprised of one or more ferrous alloys described herein. As used herein the phrase "primary completion components" includes, but is not limited to, the main elements of an oil or gas well, including the production tubing string, that enable a particular type or design of completion to function as designed. The primary completion components depend largely on the completion type, such as the pump and motor assemblies in an electrical submersible pump completion.

Referring to FIG. 1, which is highly schematic in nature, a simple downhole sampling tool ST as described herein is connected on the downhole or distal end of an insulated coiled tubing 14 just below a circulating port C. At each sampling depth, for example starting from the bottom of a vertical wellbore WB, a heated fluid, such as a heated light oil, is circulated down insulated coil 14 by means of surface pump 15 and pumped back to surface with a downhole pump (not illustrated) through non-insulated tubing, as illustrated by arrows. The rates of the surface pump 15 and the downhole pump are adjusted to maintain a drawdown from the reservoir into the wellbore. After several hours (or days) the reservoir adjacent to the insulated coil will become warm. A portion HHO of heated heavy oil composition adjacent to the distal end of insulated coiled tubing 14 will start to flow on its own. Heated heavy oil composition HHO mixes with the lighter heated fluid, and both are pumped to surface with the downhole pump. Eventually the surface pump 15 is shut down, stopping the circulation of heated fluid. The downhole pump will continue pumping, with only the heavy oil composition from the formation flowing. In certain embodiments of methods of the invention, once the surface pump 15 stops pumping heated fluid down the insulated coil, ideally there should be a short wait before sampling. Once a sample is taken, then the insulated coiled tubing 14 with sampling tool ST should be withdrawn from the well as quickly as possible, with the heated fluid injection restarted through circulation port C. This is to avoid the insulated tubing and/or sampling tool getting stuck in the wellbore which will be full of heated heavy oil which will become tar as it cools. It may also be desirable to implement training procedures for personal regarding the fact that subsequent sampling runs will have to be done quicker than the rate of wellbore cooling. Otherwise it may be impossible to reenter the well as it "sets" in a column of tar.

Figure 2:
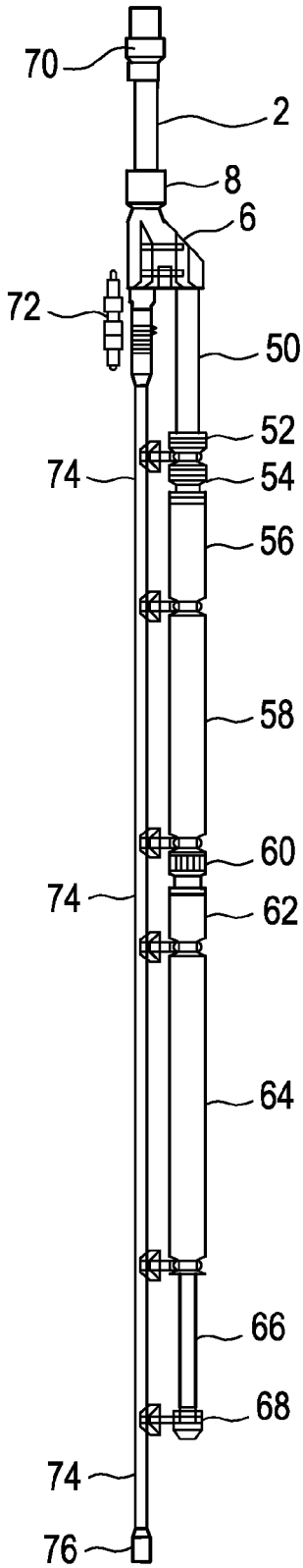
FIG. 2 is a schematic side elevation of a Y-tool useful in methods and systems of the invention.

Exemplary downhole sampling tools for use in the methods and systems of the invention are those that are compatible with a Y-tool such as that illustrated in FIG. 2, and may be battery-powered and comprise an operating clock. Such battery-powered, clock-operated production-sampling tools are useful, in certain embodiments of the invention, in synchronizing the stopping of circulation of the heated fluid and sampling of the flowable heavy oil. The production rate of heated heavy oil composition will decay rapidly as the volume of heated heavy oil composition is depleted. Therefore shortly after stopping the circulation of heated fluid from the surface, the downhole sampling tool ST will be activated (or self-activate, if on a timer) to operate. This may be achieved by synchronizing the shutdown of the surface pump with the clock operating the downhole sampler. This sampling operation may be repeated at intervals up the wellbore. Downhole sampling tools useful in methods and systems of the invention include those that are 2-in (5 cm) diameter (or smaller) sampling tools that take a sample of an annulus fluid around it. In exemplary embodiments there is no probe, pump etc. of more complicated downhole sampling tools. In certain embodiments, the tool simply comprises an empty chamber and a valve which opens with an instruction from the clock, and the entire tool is small enough to pass through the Y-tool, preferably no bigger than the 2-in (5 cm) insulated coil. One example is the tool known under the trade designation PST, from Schlumberger, a production logging tool usually used in cased holes.

As mentioned previously, methods and systems of the invention may include measuring temperature vs. time on, at, or inside the sampling tool, and optionally recording the sampling temperature vs. time. This may employ a battery-powered memory measurement sub-unit integral with the sampling tool. Exemplary methods of the invention comprise sampling the same region of the wellbore at different temperatures, with the temperature controlled via the pumped heated fluid. A surface heater may be used to supply varying fluid temperatures to the heated fluid flowing through the insulated coil, and thus to the region being sampled. This allows measuring the reservoir oil recovered as a function of different temperatures, and this temperature variant sampling could be repeated at different depths or regions of the reservoir. Thus methods of the invention may be used to sample the production of heavy oil as a function of temperature as well as depth in the reservoir.

Referring again to FIG. 1, to ensure only heated heavy oil composition HHO flows from above and opposite the downhole sampler ST, a plug P may be installed in wellbore WB, for example a sand plug. The plug P will isolate the wellbore beneath the sampler ST, and will stop any residual flow of heavy oil composition from the previously heated deeper reservoir regions from flowing into the sampler. These plugs may be placed and removed by the insulated coiled tubing 14.

Heated fluids useful in the invention function to deliver heat to regions of a formation from which heavy oil composition samples are to be obtained. The heated fluid may be selected from gases, vapors, liquids, and combinations thereof, and may be selected from water, organic chemicals, inorganic chemicals, and mixtures thereof. In certain embodiments the heated fluid comprises a non-volatile light oil or combination of non-volatile light oils. The composition is highly dependent on the particular pressures and temperatures required to produce a flowable heavy oil composition. The composition of the heated fluid also depends on the surface and downhole pumps' ability to pump heated fluids. As is known, reservoir fluids often contain suspended particles under high pressure and high temperature conditions. The particles may be in the form of a second liquid phase (hydrocarbon or aqueous based) or in the form of a solid (organic or inorganic). The presence of these particles is related to the phase behavior of the petroleum fluid and thus, the nature and/or composition of these particles may change with changes in pressure, temperature, or overall composition. In order to improve understanding of the particle phase behavior, it is desirable to obtain samples of the suspended particles at defined pressure and temperature conditions for subsequent analytical characterization. The heated fluid composition may be selected with these considerations in mind. Fluids useful in the invention for heating and circulating in the methods and systems of the invention include organic and inorganic liquids, and combinations thereof. Ideally they are non-volatile, non-flammable liquids, although this is not a strict requirement. A stricter criterion may be that the fluid chosen does not significantly harm the reservoir being sampled. Suitable organic liquids may be selected from aliphatic and aromatic compounds or mixtures thereof. Aliphatic compounds may be normal chain and/or branched chain, or cyclic having from 1to about 20 carbon atoms. Examples of suitable normal chain hydrocarbons may include n-hexane, n-heptane, and the like. Examples of suitable branched chain hydrocarbons may include iso-octane and the like, while suitable cyclic hydrocarbons include cyclohexane and the like. Suitable aromatic hydrocarbons may include benzene, toluene, xylene (ortho, meta, and para) and the like. Various types of mineral spirits may be used, for example odorless mineral spirits. A typical composition for mineral spirits is the following: aliphatic solvent hexane having a maximum aromatics content of 0.1% by volume, a kauri-butanol value of 29, an initial boiling point of 149° F. (65° C.), a dry point of approximately 156° F. (69° C.), and a specific mass of 0.7 g/cc. In the European Community, the composition of mineral spirits comes from Article 11(2) of Directive 2002/96/EC (WEEE). Various aqueous glycol solutions may be used, such as mixtures of water and ethylene glycol used in automobiles and trucks, if the reservoir may tolerate such compositions.

One set of compositions that may be useful in methods and systems of the invention are those described in assignee's published U.S. patent application Ser. No. 11/426,359, filed Jun. 26, 2006, (69.5706), incorporated herein by reference. Compositions disclosed therein comprise an asphaltene solvent and a viscosity reducing agent, the asphaltene solvent and viscosity reducing agent present in a ratio so as to substantially reduce viscosity of an asphaltene-containing material (for example heavy oils, bitumen, and the like) while substantially negating deposition of asphaltenes either in a reservoir, in production tubing, or both when mixed or otherwise contacting the asphaltene-containing material. In certain embodiments, the viscosity reducing agent may be a hydrocarbon vapor or gas (at room temperature and pressure) and the asphaltene solvent may comprise toluene or a toluene equivalent. These compositions may have large molar volume at reservoir conditions (around 5 MPa and 293 K) to maximize the gravity effect for the diluted heavy oil to flow, and may exist in single vapor phase or in supercritical state at reservoir conditions, and/or at injection pressure and temperature, and may have high vapor pressure at ambient temperature (at least as high as iso-octane) to enable recycling of the composition from the recovered oil simply by reducing the pressure, optionally with addition of heat. The asphaltene solvent and the viscosity reducing agent are at least partially miscible at temperatures above about 273 K. The asphaltene solvent and viscosity reducing agent may be present at a volume or molar ratio ranging from about 100:1 to about 1:100, or from about 10:1 to about 1:10. The viscosity reducing agent is selected from normal, branched, and cyclic alkanes having from 1 to about 20 carbon atoms, monoalkenes having from 1 to about 20 carbon atoms, carbon dioxide, pyrrolidones such as n-methyl-2-pyrrolidone (NMP), and combinations thereof. Certain useful viscosity reducing agents may be characterized as paraffinic. Certain embodiments may comprise n-alkanes having from about 3 to about 8 carbon atoms, such as propane. Drag-reducing agents, such as native and synthetic surfactants, may be utilized in certain embodiments, where "native" in this context means chemicals present in the crude heavy oil or bitumen. Surfactants may be selected from anionic, cation, nonionic, amphoteric surfactants, and combinations of two or more of these. Examples are provided herein. The asphaltene solvent may be selected from compositions comprising benzene and benzene derivative compounds within the general formula (I) and salts and mixtures thereof:

(I)

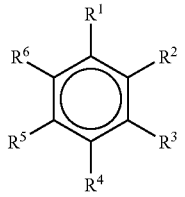

wherein $R^1$-$R^6$, inclusive, are radicals independently selected from hydrogen, hydroxyl, halogen, nitrate, amine, sulfate, carboxyl, amide, and the like, linear and branched alkyl substituents, aromatic, cyclic, alkaryl, aralkyl substituents or mixtures thereof; and where the R groups may each contain from 1-30 carbon atoms. Examples include toluene and toluene equivalents, such as benzene, xylene (ortho, meta, and para), styrene, methylbenzene, and mixtures thereof. As used herein the term benzene derivative means compounds having from one to six substituents attached to the central benzene core. Polycyclic aromatic hydrocarbons such as naphthalene, anthracene, and phenanthrene may also be present. Native and/or synthetic resins, resinous aromatic compounds, and the like may also be useful asphaltene solvents.

Well completions useful in the methods and systems of the invention comprise a non-insulated, or "normal" tubing (jointed or non-jointed) extending from the surface to the region or regions in the reservoir desired to be sampled, a Y-tool from which is suspended a downhole pump from one leg and a bypass tubing from the other leg. Each of these features is discussed in more detailed herein, as well as suitable surface pumps and downhole samplers.

A Y-tool useful in the invention, and accompanying bypass tubing and downhole pump are illustrated in FIG. 2. Illustrated is a production tubing 70, a production tubing crossover 2, a handling sub 8, and a Y-tool 6. Illustrated on the right-hand side of FIG. 2 are a pump sub 50, pump discharge head 52, a pump discharge pressure port 54, a downhole pump 56 (in this illustration a model number ESPCP S20F170, from Schlumberger), a pump rotor adaptor 58, pump intake 60, pump protector 62, motor 64, sensor unit 66, and bullnose 68. Also illustrated are an operating device 72 known as a Teleswivel, bypass tubing 74, and a re-entry guide 76.

The bypass tubing 74 suspended from Y-tool 6 is sized so that its internal diameter or bore is of sufficient size to accommodate a smaller diameter insulated coiled tubing 14 of FIG. 1, for example a 2-in (5 cm) outside diameter insulated coiled tubing. The insulated tubing external diameter is sized so that the insulated tubing may move longitudinally through the bypass tubing as required. Although a single non-insulated tubing may be employed, as well as a single insulated coiled tubing, this is not required. For example, depending on local tubing supply and the wellbore schematic profile, it may be that multiple lengths of non-insulated tubing and insulated coiled tubing may be used to sample different regions of a reservoir.

Previous coiled tubing logging plugs for Y-tools relied on a narrow gap in a brass bushing to provide a dynamic hydraulic seal. However the irregular geometry of coiled tubing due its ovality and wear, and the limited length of seal due to the plug length restrictions, creates a sizeable leak path for recirculation of the pumped fluid. In high flow rate wells, >1500 to 2000 $m^3$/day, a leak of 600 to 800 $m^3$ can be tolerated still giving good results without overheating the ESP. Thus this brass bushing design has been sufficient for the high flow rate wells in completions where the majority of the worlds coiled tubing Y-tool logging is taking place. However in low flowrate wells all the fluid will re-circulate, invalidating the production log and overheating the ESP. A new plug design was designed to overcome this problem, and is described in assignee's U.S. published patent application 20050279494, entitled "Logging Plug with High Integrity Internal Seal", incorporated herein by reference. It was an engineering challenge, as the plug wall thickness available for incorporating an improved seal is limited by the relatively large coil and the small bypass tubing. 2-in (5 cm) coils are required in certain reservoirs to reach TD of long horizontal wells. The concept was to consider the coiled tubing as a piston and have a flexible sealing mechanism. In complex yard tests, the plug sealed perfectly for 6000 ft (1830 m) of 2-in (5 cm) coil movement with varying speeds and pressures. The new plug enables multiple logging passes in a low flowrate wells.

Figure 3:
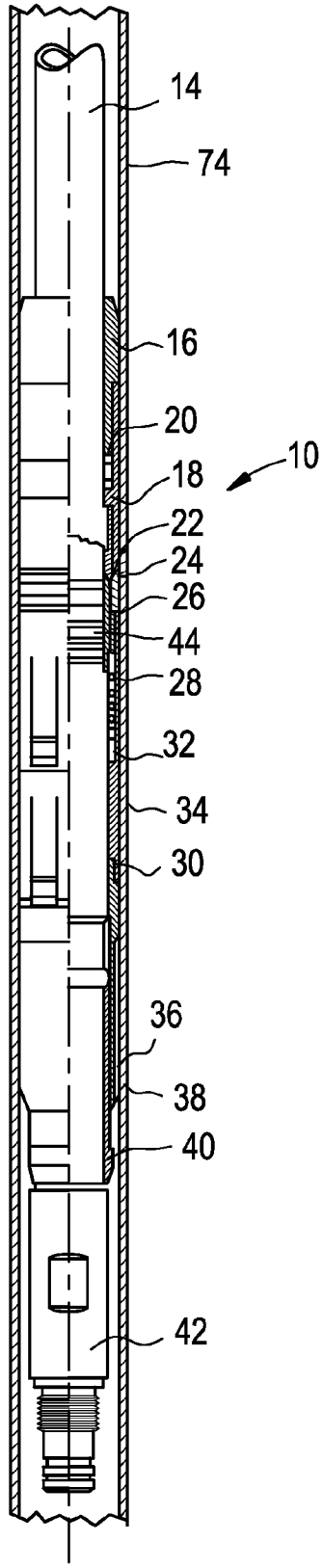
FIG. 3 (PRIOR ART)
FIG. 3 is a partial cross-sectional view of a prior art logging plug useful in the methods and systems of the present invention deployed in a bypass tubing in a Y-tool such as depicted in FIG. 2.
Figure 4:
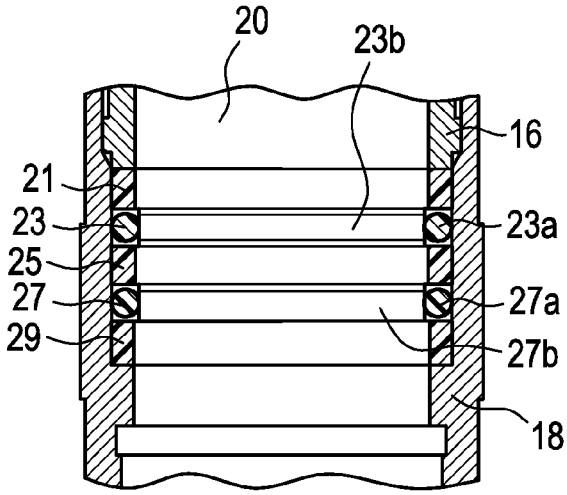
FIG. 4 (PRIOR ART)
FIG. 4 is a cross-sectional view of the internal sealing mechanism of the logging plug of FIG. 3.
Figure 5A:
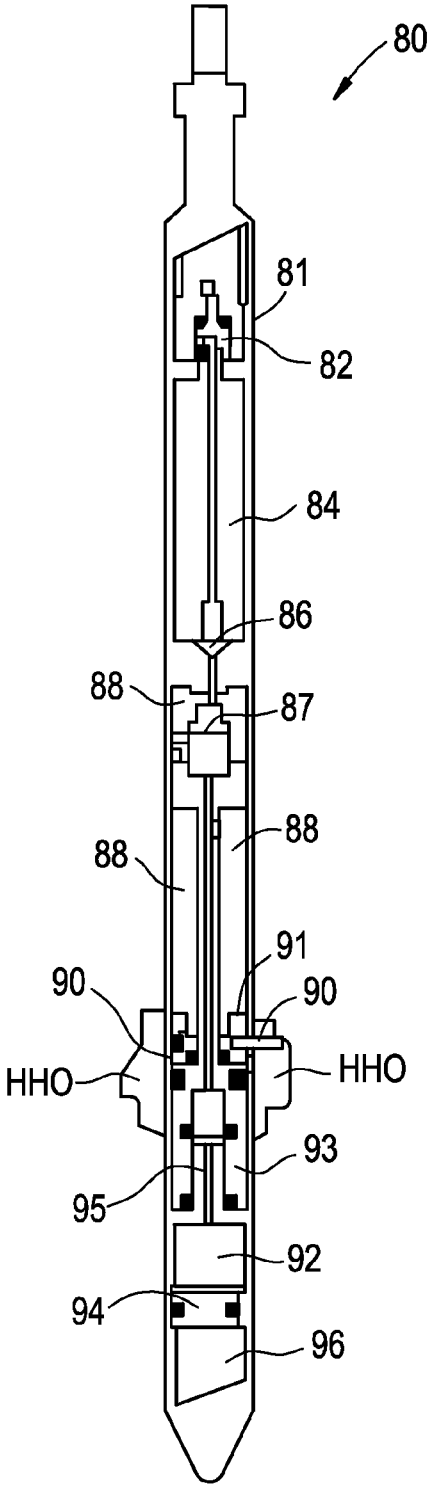
FIG. 5A (PRIOR ART)
FIGS. 5A, 5B, 5C, and 5D illustrate cross-sectional views of a prior art sampling tool useful in methods and systems of the invention.
Figure 5B:
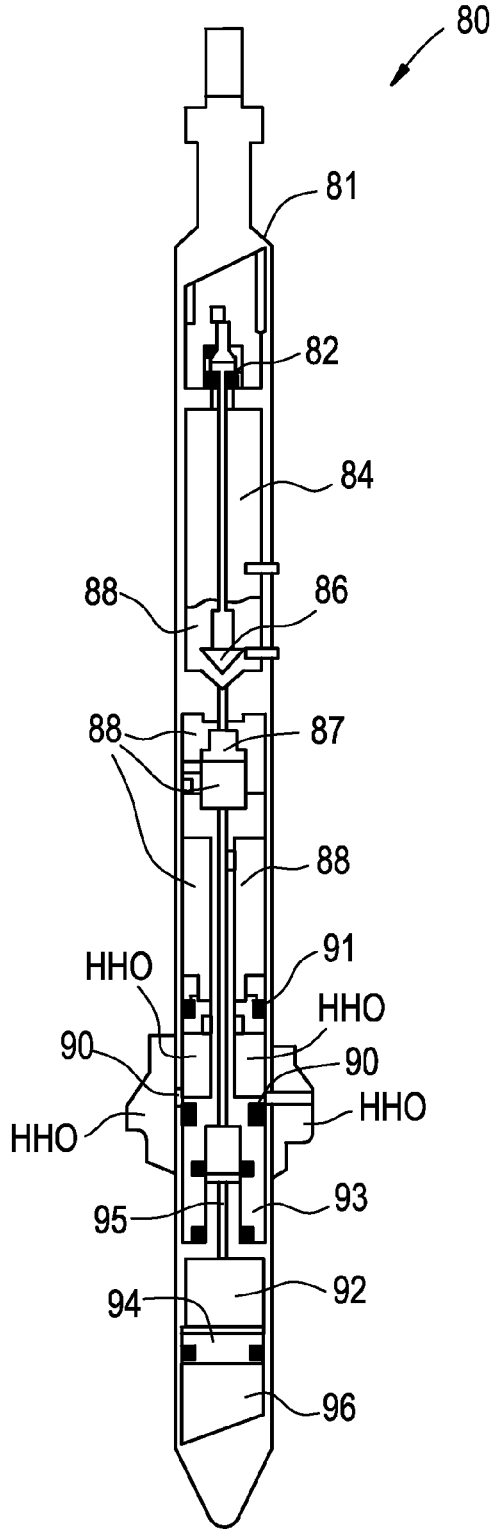
FIG. 5B (PRIOR ART)
Figure 5C:
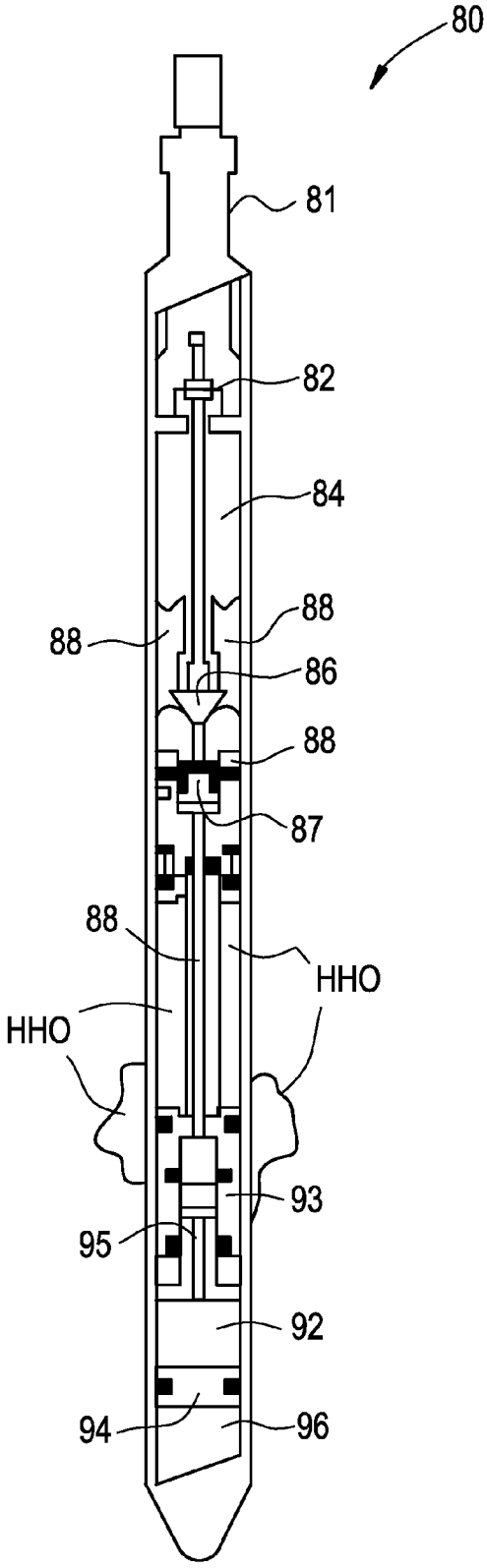
FIG. 5C (PRIOR ART)
Figure 5D:
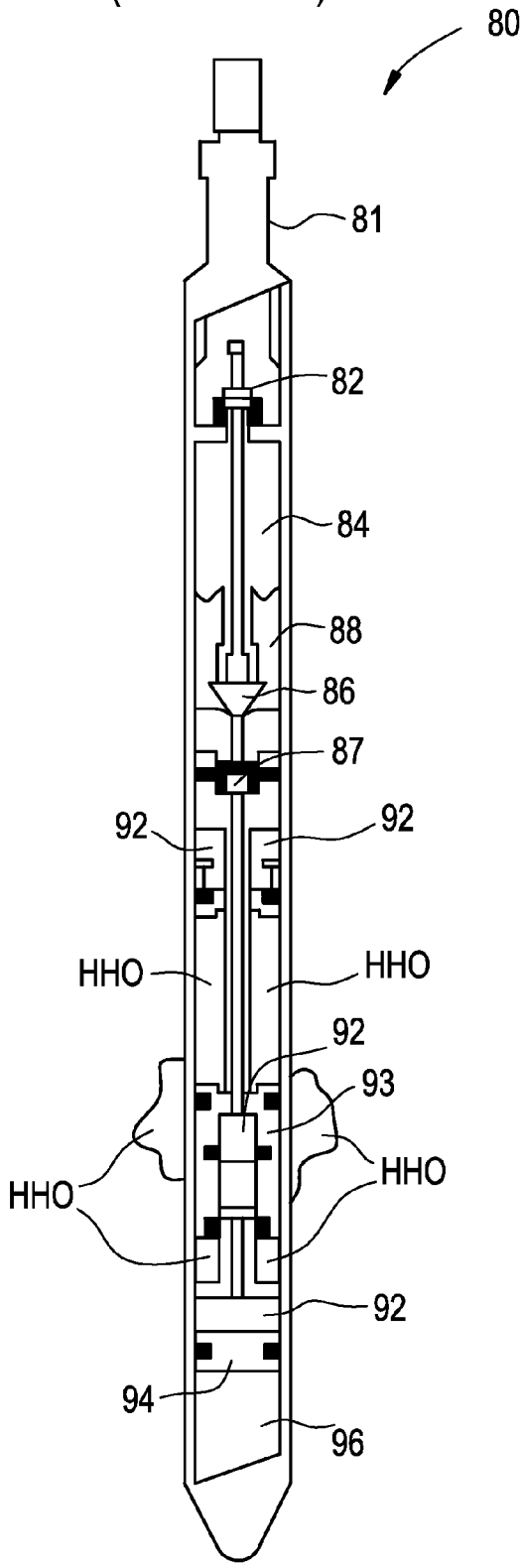
FIG. 5D (PRIOR ART)

FIG. 3 is a partial cross-sectional view of a prior art logging plug useful in the methods and systems of the present invention deployed in a bypass tubing 74 of a Y-tool such as illustrated in FIG. 2, and FIG. 4 is a cross-sectional view of the internal sealing mechanism of the logging plug of FIG. 3. FIG. 3 illustrates generally at 10 a logging plug in accordance with the '494 published patent application and useful in the present invention that is deployed in a bypass tubing 74 in a wellbore (not shown) and has an insulated coiled tubing 14 running therein for conducting reservoir sampling in the present invention. The logging plug 10 comprises a top sub 16, an internal seal housing 18, and an internal seal assembly 20 therebetween for sealing between the insulated coiled tubing 14 and the bore of the internal seal housing 18. The logging plug 10 also includes an external seal assembly 22 for sealing between the exterior surface of the logging plug and the bore of the bypass tubing 74. The external seal assembly 22 consists of a number of vee ring seals 24, as is known in the art and is supported from the bottom by an external seal housing 26. A coil spring 28 abuts the bottom of the external seal housing 26 and further abuts an inner sleeve 30 at its opposite end. The coil spring 28 is contained within a support ring 32 which is mounted between external seal housing 26 and inner sleeve 30. The lower body 34 of logging plug 10 surrounds inner sleeve 30 and extends to a bottom sub 36 in which a shear pin 38 is mounted. Shear pin 38 fixes the bottom sub 36 to retaining sleeve 40 until removal of the insulated coiled tubing 14 from the bypass tubing 74 is commenced upon completion of the sampling operation. A crossover 42 is connected at 44 to the bottom of insulated coiled tubing 14 internal to logging plug 10 and supports a downhole sampling tool 42 at its downhole end (the tool is more fully explained in the description accompanying FIGS. 5A-5D). Upon commencing a sampling operation, logging plug 10 carried on insulated coiled tubing 14 is inserted into bypass tubing 74 until logging plug 10 seats in a polished nipple in the bore of bypass tubing 74. The external vee ring seals 24 then prevent wellbore fluids from passing around the exterior of logging plug 10 by engaging the bore of the bypass tubing 74. Thereafter, the deployment of insulated coiled tubing 14 into the wellbore continues as it passes through the bore of logging plug 10 which is now stationary within bypass tubing 74. Internal seal assembly 20, described more fully in connection with FIG. 4, ensures that there is at all times a high integrity seal between insulated coiled tubing 14 and the bore of logging plug 10 to prevent wellbore fluids from recirculating into the bypass tubing 74 through this path during coiled tubing operations.

Turning now to FIG. 4, the internal seal assembly 20 of FIG. 3 is illustrated in cross-section without the insulated coiled tubing 14 therein. Internal seal assembly 20 comprises an upper ring seal 21, an upper cap seal 23, a central ring seal 25, a lower cap seal 27, and a lower ring seal 29. In addition to its sealing function, each ring seal 21, 25, 29 aids in the retention of its adjacent cap seal(s), acts as a debris barrier, and serves as a bearing for the insulated coiled tubing 14 moving through it. The ring seals 21, 25, 29 are formed of a low friction material such as PEEK, for example. Cap seals 23, 27 are self-actuating and extrusion resistant. Each cap seal 23, 27 comprises an elastomer o-ring 23A, 27A surrounded in the seal bore by a cap ring 23B, 27B. The o-rings 23A, 27A are formed of a fluoroelastomer, for example, and cap rings 23B, 27B are formed of a premium grade PTFE, such as Avalon 89, for example. As the o-rings 23A, 27A are formed of an elastomer, they energize the cap seals 23, 27 to effect good contact between the cap rings 23B, 27B and the insulated coiled tubing 14 at all times and regardless of any residual bending in the coiled tubing or distortion in its cross-section. It should be noted that cap seals 23, 27 may each comprise more than a single o-ring 23A, 27A when still further enhanced seal flexibility is required.

At the surface a heat generator and surface pump may be used to pump heated fluid down the insulated coiled tubing once in position in the bypass tubing of the well completion. Any surface pump and heat generator may be used for these purposes. Surface pumps, such as a horizontal pumping systems ("HPS"), generally include a driver, which may be a motor, turbine, diesel or non-diesel internal combustion engine, generator, and the like, in some cases combined with a protector, seal chamber, and the like, and a pump mounted on a horizontal skid. Horizontal pumping systems may be used in the present invention to pump a heated fluid to the region of the reservoir for which one or more samples is desired. As explained in assignee's U.S. Pat. No. 6,425,735, the motor may be fixedly coupled to horizontal skid at a motor mount surface of the horizontal skid. The pump may be coupled to the horizontal skid by a mount assembly, which may include a support (e.g., a fixed support) and clamp assemblies. The pump may be drivingly coupled to the motor through support. Alternatively, the support may be an external conduit assembly configured for attachment to a pump conduit, such as one of two pump conduits extending from the pump.

The downhole pump may be selected from any downhole pump compatible with heated fluids and the Y-tool, where "heated" implies any temperature over 150° F. (65° C.). An example of such a pump is that known under the trade designation "Hotline ESP" from Schlumberger. The downhole pump may be a positive displacement pump or centrifugal pump. Suitable positive displacement pumps include progressive cavity pumps (PCP), such as the model ESPCP S20F170 discussed in relation to FIG. 2. Other PCPs may be used, such as those available from Kudu Industries Inc., Calgary, Alberta, Canada under various trade designations such as "15 TP 600 SL", "30 TP 650 SL", "80 TP 400 SL", and "1000 TP 200 SL", for example. At 500 rpm rotor speed and zero head, these PCPs may pump 15, 27, 80, and 1000 $m^3$/day, respectively. The downhole pump may be an electrical submersible pump ("ESP"), such as pumping systems known under the trade designation Axia™, available from Schlumberger Technology Corporation, or modifications thereof. Pumps of this type may feature a simplified two-component pump-motor configuration, with pump having one or more stages inside a housing, and a combined motor and protector. The pump may be built with integral intake and discharge heads. Fewer mechanical connections may contribute to faster installation and higher reliability of these ESPs. The combined motor and protector assembly, known under the trade designation ProMotor™ may be prefilled in a controlled environment, and may include integral instrumentation that measures downhole temperatures and pressures. Alternative electrical submersible pump configurations which may be employed in methods and systems of the invention include an ESP deployed on cable, and an ESP deployed on coiled tubing with power cable strapped to the outside of the coiled tubing (the tubing acts as the producing medium). For example, three "on top" motors may drive three pump stages, all pump stages enclosed in a housing. The pump stages may be identical in number of pump stages and performance characteristics, while some pump stages may have different performance characteristics. A separate protector may be provided, as well as an optional pressure/temperature gauge, sub-surface safety valve (SSSV) and a chemical injection mandrel. The technology of bottom intake ESPs (with motor on the top) has been established over a period of years. It is important to securely install pump stages, motors, and protector within coiled tubing, enabling quicker installation and retrieval times plus cable protection and the opportunity to strip in and out of a live well.

The collection and sampling of underground fluids contained in subterranean formations is well known. In the petroleum exploration and recovery industries, for example, samples of formation fluids are collected and analyzed for various purposes, such as to determine the existence, composition and producibility of subterranean hydrocarbon fluid reservoirs. This aspect of the exploration and recovery process may be crucial in developing exploitation strategies and impacts significant financial expenditures and savings. Examples of downhole sampling tools are disclosed in U.S. Pat. Nos. 4,860,581; 4,936,139; 6,223,822; 6,457,544; 6,668,924, and published U.S. patent applications 20050082059; 20050279499; and 20060175053, all assigned to the assignee of the present invention. Various other methods and devices have been proposed for obtaining subterranean fluid samples. For example, U.S. Pat. No. 6,230,557 to Ciglenec et al., U.S. Pat. No. 6,223,822 to Jones, U.S. Pat. No. 4,416,152 to Wilson, U.S. Pat. No. 3,611,799 to Davis and International Pat. App. Pub. No. WO 96/30628 have developed certain probes and related techniques to improve sampling. Other techniques have been developed to separate clean fluids during sampling. For example, U.S. Pat. No. 6,301,959 to Hrametz et al. discloses a sampling probe with two hydraulic lines to recover formation fluids from two zones in the borehole. Borehole fluids are drawn into a guard zone separate from fluids drawn into a probe zone. Despite such advances in sampling, there remains a need to develop techniques for fluid sampling of heavy oil compositions.

Illustrated in FIGS. 5A-5D are four stages of operation of an annular downhole sampling device 80 useful in the inventive methods and systems. This particular sampling device is known under the trade designation "Single-Phase Reservoir Sampler (SRS)", from Schlumberger, but other equivalent samplers may also be useful. Sampling device 80 may be used in conjunction with a Field Transfer Unit (FTU), 102, an optional heating jacket, and a Single-Phase Sample Bottle (SSB), 103, as discussed herein in reference to FIGS. 6A-6D. The SRS sampling tool 80 is a bottomhole pressure compensating sampling tool and can be run in strings of up to 8 tools on slickline, electric line, coiled tubing, sucker pump rods, or bundle carrier (SCAR-A). Each tool has its own clock, 82, allowing complete flexibility in deciding when and at what well depth individual tools in the string take a sample. The SRS sampling tool is rated to 15,000 psi (103 MPa) working pressure, 22,500 psi (155 MPa) test pressure and 400° F. (204° C.).

To collect a sample in accordance with the inventive methods and systems, the SRS unit 80 is attached to the distal end of an insulated coiled tubing and is conveyed downhole, through the bypass line 74 of a Y-tool. Each SRS is independently triggered to trap a sample by either high temperature clock 82, which may be a mechanical clock having a delay of up to 12 hours, or an electronic clock for long duration operations of up to several weeks. Alternatively, a rupture disk may trigger when the SRS is run in a sample carrier (SCAR-A) as part of the DST string and activated by applied annulus pressure. The sampling tool includes a main body 81, an air chamber 84, a regulator valve 86, a closure device 87, a chamber for buffer fluid 88, and sampling ports 90. Sampling tool 80 also comprises a floating piston 91, a chamber filled with pressure compensating fluid 92, a disk separator 94, and another chamber 96 filled with nitrogen or other inert gas. A fixed piston 93 and spool valve 95 complete this version of the downhole sampling tool.

When fired, sampling device 80 recovers a 600 cc sample by the controlled displacement of heated heavy oil (HHO) reservoir fluid, the reservoir fluid acting on floating piston 91 inside the sample chamber. The complete sampling process takes approximately five minutes, and is illustrated in four steps in FIGS. 5A (running position), 5B (start of sampling), 5C (completing sampling and closing sample chamber), and 5D (pressure compensation). A nitrogen charge on the surface primes the pressure compensating fluid, with sample ports 90 closed. Mechanical or electrical clock 82 sets opening time of regulator valve 86. At the start of sampling, regulator valve 86 is opened by clock 82. Buffer fluid 88 passes to air chamber 94, and floating piston 91 is moved by ingress of reservoir fluid, HHO. Upon completion of sampling, the sample chamber is full of reservoir fluid, HHO. Floating piston 91 acts on closure device 87, while fixed piston 93 moves into the sample chamber isolating the HHO sample. The mechanical locking closure device 87 ensures the sampling tool ports 90 cannot reopen. As closure is completed, spool valve 95 opens releasing pressure compensating fluid 92. As the tool is retrieved using normal (non-insulated) coiled tubing, normally the temperature would drop and the sample would shrink. However, by re-initiating flow of heated fluid through the insulated coiled tubing as taught herein, this may be minimized. A preset pressure is maintained on the sample by the pressure compensating fluid 92. Preset pressure is determined by nitrogen charge pressure prior to running.

After the successful capture of the sample, the SRS sample chamber is locked both mechanically and hydraulically. The sample is then maintained at or above reservoir pressure during retrieval by the release of a pre-set nitrogen charge. The nitrogen in chamber 96 acts like a spring on the HHO sample through the floating piston 91 acting on buffer fluid 88, which may be a synthetic oil, thus avoiding nitrogen contamination of the HHO sample. The recovery pressure is generally set at several thousand psi (or hundred MPa) above the bubble point pressure, or in the case of asphaltene studies, above the reservoir pressure.

Figure 6B:
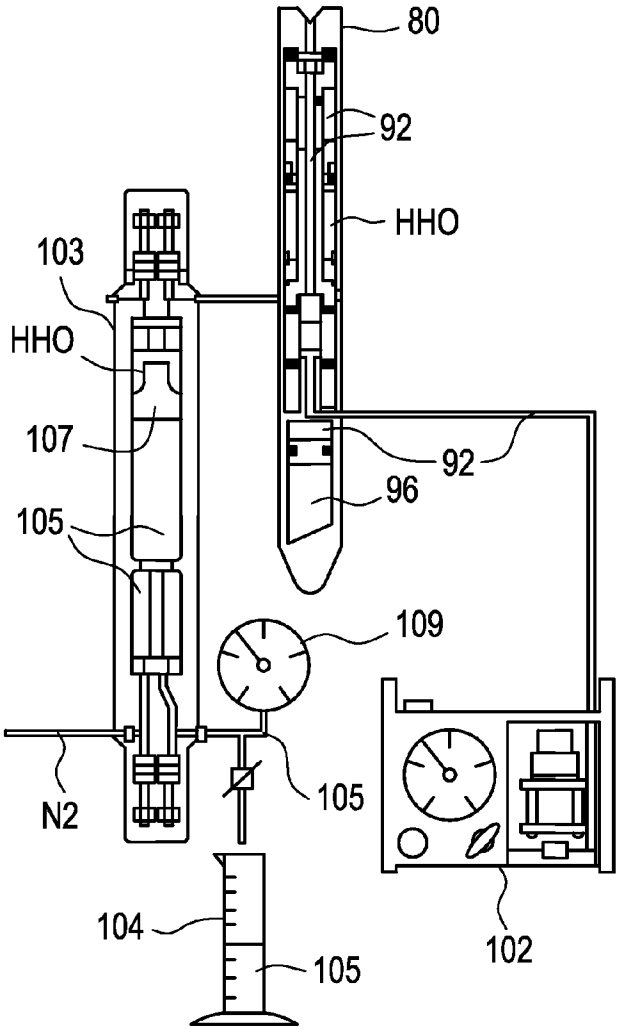
FIGS. 6A, 6B, 6C, and 6D illustrate cross-sectional views of a prior art sampling transfer system useful in the methods and systems of the invention.
Figure 6A:
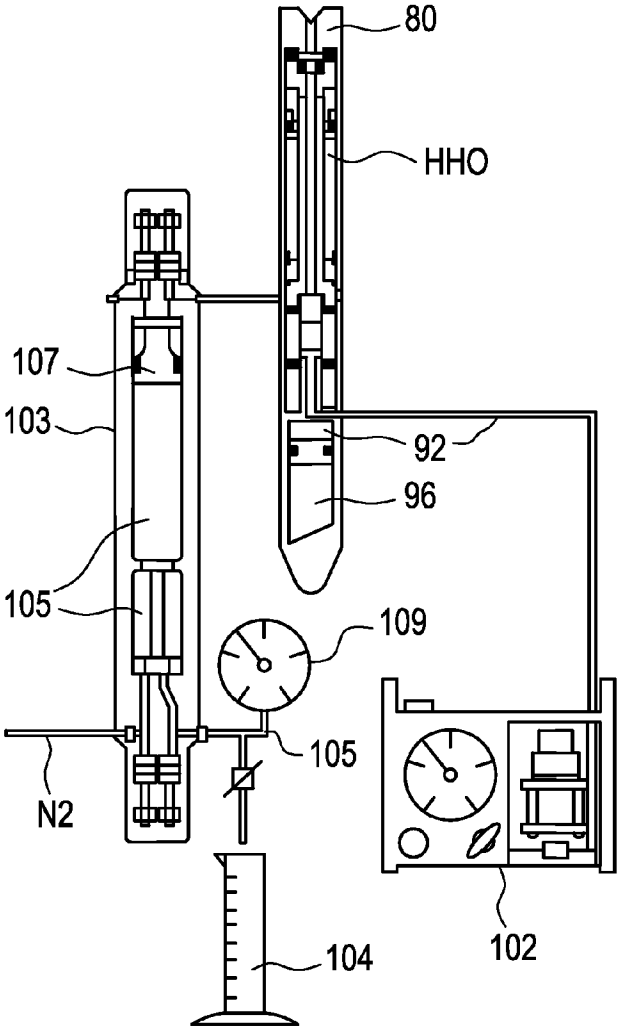
Figure 6D:
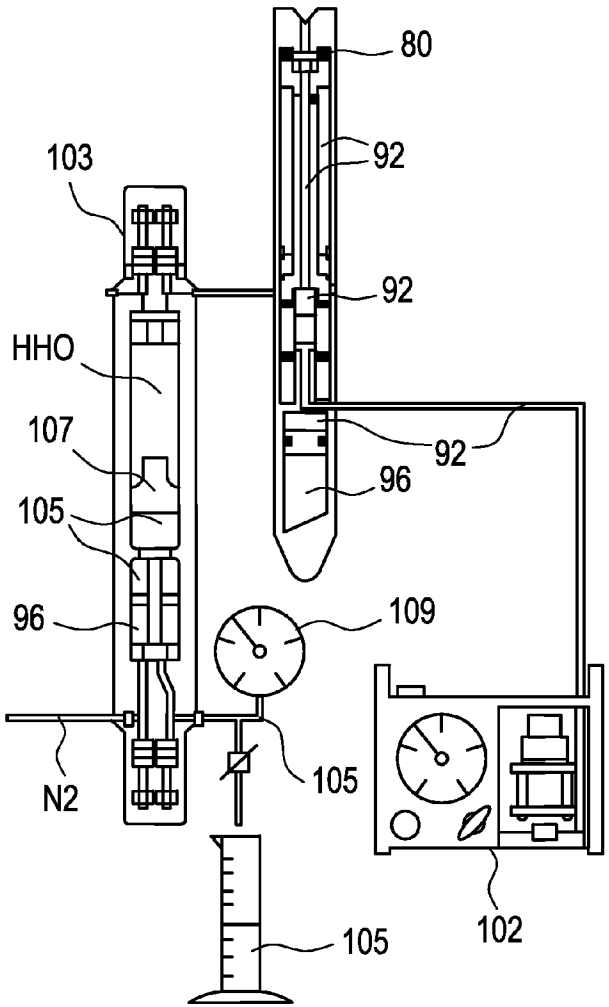
Figure 6C:
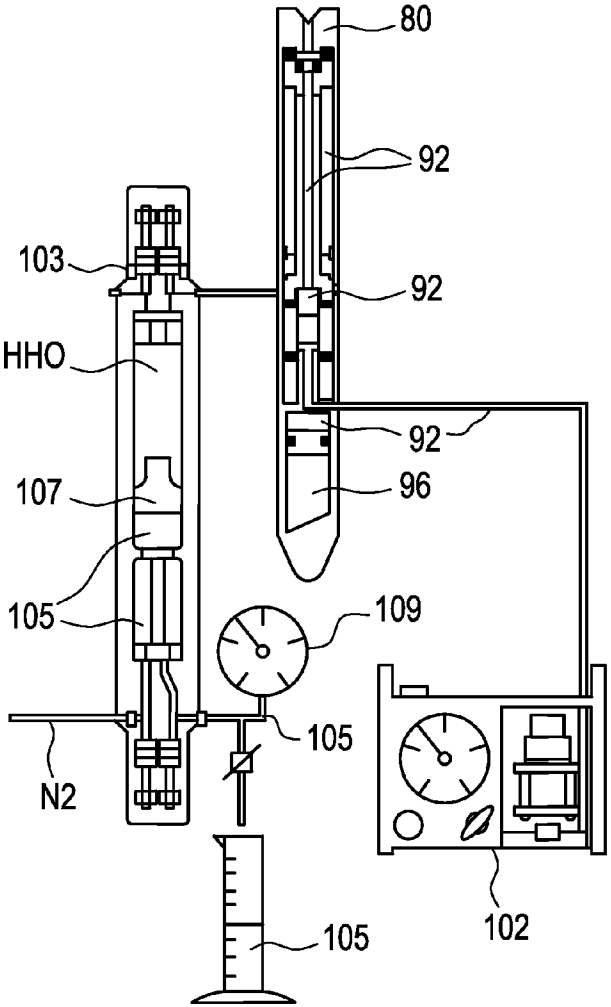

The sampling tools rely on elastomer seals between the sample and the atmosphere and are therefore not ideal for long term sample storage or transportation. When the sampling tool is recovered to surface, the sample is therefore transferred at reservoir conditions from the sampling tool into a pressure-compensated sample cylinder 103, as illustrated in FIGS. 6A-6D. FIG. 6A illustrates the initial rig up, FIG. 6B illustrates commencement of transfer of sample; FIG. 6C illustrates completion of transfer, and FIG. 6D illustrates creation of a nitrogen or other inert fluid gas cap. The sample cylinder may be that known under the trade designation Single-Phase Sample Bottle, or (SSB), from Schlumberger, although any similarly constructed sample bottle will suffice. Sampling tool preparation and well-site sample transfers into the sample cylinder 103 may be performed using an apparatus known under the trade designation Field Transfer Unit (FTU), 102, a portable workstation available from Schlumberger, which has three dedicated high pressure pumps for nitrogen, synthetic oil and a water/glycol mixture. Transfers of samples at up to reservoir temperature may be possible by using a heating jacket (not illustrated). The system further includes a reservoir 104 for collecting water/glycol, a pressure gauge 109, and a nitrogen (or other inert gas) supply N2. Sample cylinder 103 includes a piston 107, and varying volume chambers 105 filled with a water/glycol solution (for example).

The minimum size or amount of sample collected is determined by the minimum sample requirement for the specific analytical method of choice, typically viscosity. Some of the currently available compositional analysis techniques only require nanograms of material for proper analysis, however, viscosity analyses may require significantly more volume of sample. Depending on the volume of sample required, multiple sample collections may be required to collect enough material for analysis. For these and other reasons, systems and methods of the invention may be automated. Sample collected may comprise gaseous, liquid, supercritical phases, and any combination thereof. The sample may comprise any sample at elevated temperatures and pressures, including, but not limited to compositions comprising hydrocarbons (including sour hydrocarbons which may include hydrogen sulfide, mercaptans, and other sulfur-containing compounds), water, organic and/or inorganic solids, and may include micelles, macromolecules, globules, resins, asphaltenes, hydrocarbon and aqueous based fluids, drilling muds, frac fluids, and the like having multiple phases (solids and liquid).

Thermally insulating coiled tubing has only just become available. For, example a company named MAJUS in the United Kingdom is developing such a coil using subsea pipeline technology. The heat loss in 2000 m of their coil is expected to be only 5%. With this specialized coil it will be possible to pump heated fluids without much heat loss, making it possible to apply heat to the reservoir and pump fluids from the reservoir simultaneously.

Figure 7:
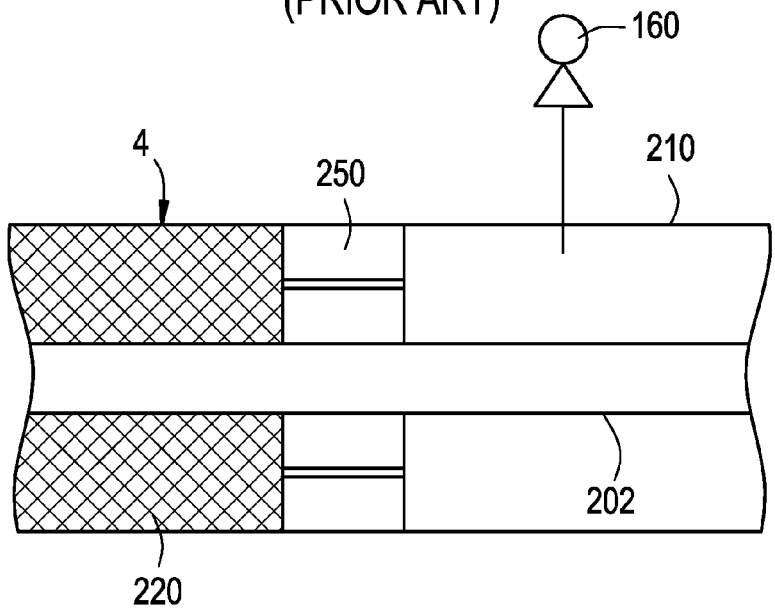
FIG. 7 (PRIOR ART)
FIGS. 7 and 8 are cross-sectional views of two prior art concentric coiled tubing embodiments useful in the methods and systems of the invention.

As explained in U.S. Patent publication number 20060175053 A1, published Aug. 10, 2006, incorporated herein by reference, and assigned to MAJUS, United Kingdom, several possibilities exist to provide insulation between the two tubes of an insulated tubing. FIG. 7 shows a cross section of coiled tubing 4 particularly suited to methods and systems of the invention. Tubing 4 is produced using the technique known as "pipe in pipe". A first inner pipe 202 ensures the transport of the fluid. This first pipe 202 is mechanically protected by a second external pipe 210 of a greater diameter concentric to the first pipe 202. Between the two pipes there is insulator 220. A vacuum is a very good insulator, however, given the great lengths of pipe in question, compression stresses in the annular space between the tubes and the thermal variations which may cause buckling stress in pipes, vacuum insulation is not able to ensure that these two pipes will not come into contact with one another. Such contact would firstly eliminate the insulating vacuum between the two pipes and would also lead by conduction to substantial thermal losses, more so because the pipes are made of metallic material. These contacts may be avoided by introducing spacers 250 between the two pipes. A rigid insulator 220 may be introduced into the space between tubes able to withstand crushing and which will act as a spacer to prevent the tubes from coming into contact. The material used to produce these spacers must have good insulating properties. Such a material may advantageously be a microporous material. This microporous material, which may be of the type described in U.S. Pat. No. 6,145,547, incorporated herein by reference, is advantageously obtained by compressing a powder, for example a mixture containing a major portion of silica together with a minor portion of titanium dioxide. Such a compressed microporous material advantageously has a density of between 200 and 400 kg/m$^3$. The thermal insulating capacities of such a material are considerably improved when it is placed at low pressure in the annular space between the two pipes. Such low pressure, advantageously between 1 mbar and atmospheric pressure, may be obtained here by using a vacuum pump 160 between concentric tubes 202 and 210. The spacer function fulfilled by such a microporous material may be obtained if it is used to totally fill the space between the two tubes. From a mechanical point of view, it is also possible to position spacers made of this microporous material which are only a few centimeters in length evenly along the tubing 4, at intervals ranging from about 0.1 to about 1 meter, thereby ensuring reinforcement against any crushing of the insulator.

Figure 8:
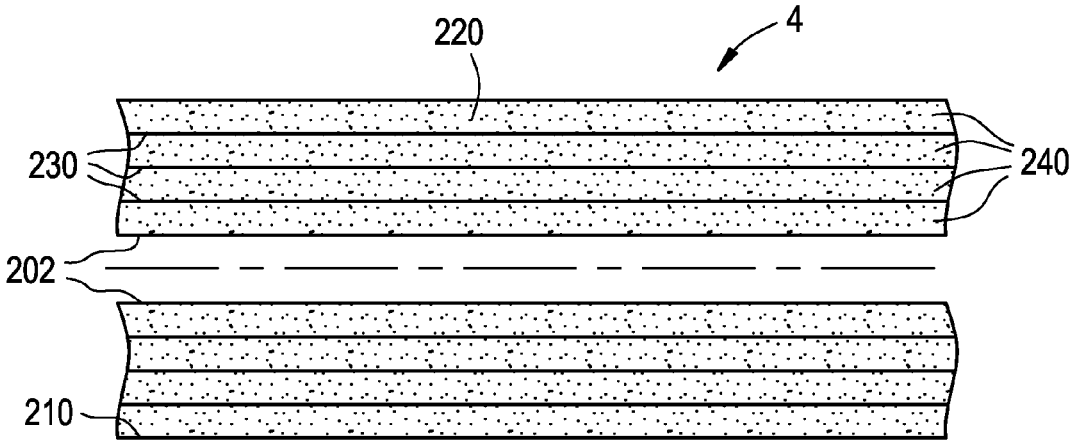
FIG. 8 (PRIOR ART)

An insulator 220 may also be made by producing a multilayer superinsulator constituted by reflective screen sheets 230 sandwiching layers of powder 240 such as that described in published U.S. patent application 20050100702, incorporated herein by reference, and illustrated schematically in FIG. 8. The screens are constituted by a reflective sheet, for example aluminum, onto which the powder is deposited, wound in a spiral around itself. The powder 240 may have a granulometry substantially equal to 40millimicron pores whose size is of the order of magnitude of the mean free path of the gas molecules in which this powder is placed and a density of between 50 and 150 kg/m$^3$. Advantageously, pressure of between $10^{-2}$ and 1 mbar may be maintained between the two tubes of the insulated coiled tubing. It is also possible for an insulator 220 to be made by combining the use of multilayered reflective screen sheets 230 with a partial vacuum of around $10^{-2}$ to 1 mbar. Such an insulator enables the production zone to be heated to a temperature close to 200° C. enabling the viscosity of the heavy oil composition to be considerably reduced and thus ensuring an acceptable sample.

Insulated coiled tubing is also described in U.S. Pat. No. 6,015,015, incorporated herein by reference. Insulated coiled tubing therein described comprises, in certain embodiments, a continuous coiled tubing composite including an inner coiled tubing positioned within an outer coiled tubing. The two tubing lengths define an annulus that may be insulated, or may contain insulation material. As noted in the '015 patent, and consistent with the '053 published patent application of MAJUS discussed above, it is understood that one means of "Providing insulation" is to provide a vacuum. A vacuum may comprise an insulating material. A plurality of centralizers are longitudinally spaced within the annulus separating the tubings. The composite itself retains sufficient flexibility for reeling on a truckable spool and sufficient stiffness for injecting in a bore. Size is generally a constraint in downhole operations. It will typically be desired that a coiled tubing composite perform its function while minimizing the composite's outside diameter. As mentioned in the '015patent, for that reason, "concentric" coiled tubing, as opposed to off centered tubing, may be a more cost effective and practical design when dual coils are to be utilized. Concentricity has further structural benefits when taking into consideration the operations of reeling a dual coiled tubing string on a spool. However, it should be understood that insulated dual coiled tubing could function if it were not concentric, or if a plurality of "centralizers" separated but did not maintain exact "concentricity."

The inner tubing length and the outer tubing length that form a useful insulated coiled tubing each may comprise at least several hundred, or several thousand feet or meters. Useful insulated coiled tubing would exhibit sufficient structural integrity, including flexibility and stiffness, to be repeatedly reeled and unreeled into, and repeatedly injected and withdrawn from, a wellbore, as explained in the '015 patent. The annulus between the inner and outer coil may be sealed against fluid communication with the environment exterior to the tubing. The annulus may be sealed to generally exclude fluid communication from outside the environment while providing for at least limited internal fluid communication within the annulus itself. In certain embodiments of insulated concentric coiled tubing useful herein, at one end of the insulated coiled tubing the inner tubing length may be affixed to the outer tubing length while at the other end of the composite both lengths may be attached to an expansion joint. At each end of a section the inner length may seal against either the outer length or an expansion joint, thereby sealing the annulus between the two tubings.

The maximum external diameter of the inner tubing of the insulated tubing is limited only by the inner diameter of the outside tubing and the requirement of thermal insulation so that major heat loss is not exhibited by the heated fluid flowing through the inner tubing. The external diameter of the outer tubing is limited only by the need for the insulated tubing to be able to be positioned inside the bypass tubing of the well completion. It is envisioned that the outside diameter of the inner tubing of the insulated tubing may range from one inch (2.54 cm) to about five inches (12.7 cm) while the outside diameter of the outer tubing length could range from between two inches (5.1 cm) and six inches (15.2 cm). The annulus is preferably about ½ inch wide (about 1.25 cm). The annulus need not have the same width in all locations. The "insulation" of the insulated coiled tubing may be selected from vacuum, inert gas, loose fill particles, and in particular, finely ground loose fill particles, for example finely ground perlite of suitable mesh size (1.19 mm), and combinations of any of these.

Centralizers may be present in the annulus between inner and outer tubes of insulated coiled tubing useful in the methods and systems of the invention. Useful centralizers provide for fluid communication longitudinally through the centralizers. Such communication may be provided by outer peripheral grooves, which also serves to minimize radial thermal conduction. Preferably the centralizers comprise split steel rings spaced between the two tubes at intervals of between five and seven feet (1.5 m to 2.1 m), or at approximately six foot (1.8 m) intervals.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A method comprising:

(a) circulating a heated fluid in a first region of a reservoir where a heavy oil composition is present or believed present using a surface pump and a well completion comprising a downhole pump for a time and flow rate sufficient to produce flowable heavy oil composition, the well completion comprising a sampling tool; and (b) sampling the flowable heavy oil composition using the sampling tool.

2. The method of claim 1 wherein the circulating comprises installing a well completion in a wellbore near the first region of the reservoir, the well completion comprising a non-insulated tubing, a downhole pump connected to an end of the non-insulated tubing, and a bypass tubing.

3. The method of claim 2 comprising inserting an insulated coiled tubing through the bypass tubing, a distal end of the insulated coiled tubing having the sampling tool affixed thereto.

4. The method of claim 3 wherein the heated fluid is a non-volatile oil, and the circulating comprises pumping the heated non-volatile oil through the insulated coiled tubing and into the first region of the reservoir using the surface pump.

5. The method of claim 4 wherein the circulating comprises pumping at least a portion of the heated non-volatile oil to the surface using a downhole pump until a heated heavy oil composition begins to flow from the first region of the reservoir.

6. The method of claim 5 comprising stopping the surface pump, thus stopping pumping of the heated non-volatile oil, while maintaining pumping using the downhole pump.

7. The method of claim 1 comprising inserting a plug in the wellbore near the first region after the sampling so that heavy oil composition near the first region may not flow.

8. The method of claim 1 comprising analyzing viscosity of the flowable heavy oil composition.

9. The method of claim 8 comprising repeating the circulating, sampling, and analyzing steps at a plurality of regions in the reservoir.

10. The method of claim 1 comprising synchronizing the sampling to occur substantially immediately after the circulating is stopped.

11. The method of claim 1 wherein the heated fluid is selected from organic fluids, inorganic fluids, and combinations thereof.

12. The method of claim 11 wherein the heated fluid is organic and is selected from non-volatile light oils or a combination of non-volatile light oils.

13. The method of claim 1 comprising measuring temperature vs. time on, at, or inside the sampling tool at the first region of the reservoir, and optionally recording the sampling temperature vs. time.

14. The method of claim 13 comprising controlling temperature of the heavy oil on, at, or inside of the sampling tool using the heated fluid.

15. The method of claim 14 comprising adjusting temperature of the heated fluid, and thus to the first region being sampled, using a surface heater.

16. The method of claim 15 comprising repeating the sampling, adjusting temperature, and temperature measuring at different regions of the reservoir and measuring amount of production of the heavy oil recovered as a function of temperature and/or depth or region of the reservoir.

17. A method for obtaining a heavy oil sample from a reservoir comprising:

(a) installing a well completion in a wellbore near a first section of a heavy oil reservoir, the well completion comprising:

(i) a non-insulated tubing;

(ii) a downhole pump connected to an end of the non-insulated tubing; and (iii) a bypass tubing;

(b) inserting an insulated coiled tubing through the bypass tubing, a distal end of the insulated coiled tubing having a sampling tool affixed thereto;

(c) pumping a heated non-volatile oil through the insulated coiled tubing and into the first section of the reservoir using a surface pump;

(d) pumping at least a portion of the heated non-volatile oil to the surface until heated heavy oil begins to flow from the first section of reservoir;

(e) stopping the surface pump, thus stopping pumping of the heated non-volatile oil, while maintaining pumping of fluid using the downhole pump; and (f) sampling heavy oil using the sampling tool.

18. A system comprising:

(a) a well completion in a wellbore near a first section of a heavy oil reservoir, the well completion comprising a non-insulated tubing, a downhole pump connected to an end of the non-insulated tubing, and a bypass tubing having an internal diameter;

(b) an insulated coiled tubing having an external diameter less than the internal diameter of the bypass tubing, allowing the insulated tubing to move longitudinally through the bypass tubing, a distal end of the insulated coiled tubing having a clock-operated, battery-powered sampling tool affixed thereto; and (c) a surface pump for pumping a heated non-volatile oil through the insulated coiled tubing and into the first region of the reservoir.

19. The system of claim 18 wherein the downhole pump is selected from progressive cavity pumps and electric submersible pumps, and wherein the insulated tubing comprises a tubing in tubing design comprising an inner tubing and an outer tubing forming an annulus therebetween, the annulus filled with an insulating material.

* * * * *